US006282988B1

(12) United States Patent
Erickson

(10) Patent No.: US 6,282,988 B1
(45) Date of Patent: Sep. 4, 2001

(54) RETROFITTABLE DEVICE TO RENDER A HAMMER HEAD MAGNETIC

(76) Inventor: R. L. Erickson, 2534 Greendale Dr., South San Francisco, CA (US) 94080

( * ) Notice: Subject to any disclaimer, the term of this patent is extended or adjusted under 35 U.S.C. 154(b) by 0 days.

(21) Appl. No.: 09/670,859

(22) Filed: Sep. 26, 2000

(51) Int. Cl.[7] ..... B25D 1/00
(52) U.S. Cl. ..... 81/24; 81/180.1
(58) Field of Search ..... 81/20, 21, 23, 81/24, 180.1, 185.1

(56) References Cited

U.S. PATENT DOCUMENTS 2,671,483 * 3/1954 Clark ..... 81/24
3,067,790 * 12/1962 Tucker ..... 81/21
3,164,178 * 1/1965 Belgard ..... 81/21
3,228,720 * 1/1966 Jordan ..... 81/24
3,229,738 * 1/1966 Blanchini ..... 81/21
3,763,906 * 10/1973 Crowder ..... 81/24
4,367,778 * 1/1983 Bradbury ..... 81/23
4,753,138 * 6/1988 Soucy ..... 81/24
5,178,048 * 1/1993 Matechuk ..... 81/24

* cited by examiner

*Primary Examiner*—Eileen P. Morgan
*Assistant Examiner*—Joni B. Danganan
(74) *Attorney, Agent, or Firm*—Flehr Hohbach Test Albritton & Herbert LLP

(57) ABSTRACT

An attachment is retrofittably attachable (and detachable) to a conventional hammer to render the hammer head magnetic for purposes of starting a metallic fastener such as a nail. The attachment includes a cup-like housing within which is disposed a magnetic unit that includes at least one magnet. One surface of the magnetic unit magnetically attaches the unit to the striking surface of the hammer head. The head of a metallic fastener is magnetically attachable to the other surface of the magnetic unit.

20 Claims, 3 Drawing Sheets

RETROFITTABLE DEVICE TO RENDER A HAMMER HEAD MAGNETIC

FIELD OF THE INVENTION

The invention relates generally to hammers and hammer-like tools, and more specifically to hammers that can magnetically retain a nail or other fastener to the head region of the hammer at a proper angle for driving the nail into a work surface using one hand.

BACKGROUND OF THE INVENTION

Hammers and hammer-like tools have been known in the art for many centuries, and are used to drive a nail or other fastener into a working surface, e.g., wood, concrete. Hammers comprise a user-holdable handle to which a head is attached. While the handle may be fabricated from a non-metal material such as wood or fiberglass, the hammer head is made from a durable metal. A durable metal, e.g., steel is preferred since the hammer head is used to forcibly strike a typically metal nail or other joining device.

It is a relatively easy task to start a nail into the surface of the material being worked up when the material is not substantially higher than the head of the hobbyist, carpenter, contractor, or other person using the hammer, collectively the "user". The user simply holds the nail (or other joining device in one hand), and strikes the head of the nail with the head of the hammer, while holding the hammer in the other hand. Once the nail has been struck and is at least partially lodged into the material being worked upon, the user needs only one hand to deliver further hammer blows to drive the nail home.

However starting a nail into a work surface can be rather difficult if the work surface is substantially higher than the user's head. The position to be nailed may be within range of the hammer head but may be slightly beyond reach of the user's free hand. The task of starting a nail into the work surface can be exceedingly difficult when the surface is completely overhead, for example a ceiling to which sheet rock or the like is to be attached. Carpenters using a hammer during a framing operation often need to hold the work surface with one hand, while attempting to use a hammer to start and drive a nail with the other hand.

Such task would be simplified if the nail or other joining device could temporarily be attached to the hammer head, with the sharp end of the nail facing away from the head.

It is known in the art to apply a tacky adhesive to the striking surface of a hammer head, which adhesive can retain the nail at least for the initial hammer blow. Understandably it is necessary not merely to retain the nail to the hammer striking surface, but to retain the nail at a proper starting angle. Adhesives can be messy in practice, and grease, oil, dust and the like on the nails being used can rapidly reduce the effectiveness of the adhesive. A nail that has detached itself from a hammer head may cause injury to nearby persons.

More preferably, magnetic hammer heads are known in the art. For example, USP 4,073,327 to Pearson (1978) disclosed a modified hammer head in which a central portion of the original head is removed and replaced by a magnetic material. USP 3,580,312 to Hallock (1971) disclosed another configuration in which the ferrous head of a conventional hammer includes at least chamber formed at right angles to the striking surface. A permanent magnet is sealed within each chamber to magnetize the hammer head.

Note that magnetic hammers such as disclosed by Pearson and Hallock are essentially dedicated hammers in that the magnetic feature is always present, at least until the magnetism is lost. Stated differently, it is not feasible to instantly render a Pearson or Hallock hammer non-magnetic, then render it magnetic, then non-magnetic, and so forth, depending upon the nature of the task at hand.

Although prior art magnetic hammer heads are useful for starting nails in difficult to reach locations, especially ceilings, dedicated hammer heads such as disclosed by Pearson and Hallock have certain disadvantages. The repeated impact of the magnetized hammer head against nails can result in a loss of magnetism in the hammer head. Since the above-described prior art hammers use a dedicated hammer head, e.g., a head that has been permanently modified or manufactured to be magnetic, it will eventually be necessary to replace the entire hammer head. But magnetic hammer heads are expensive to replace. Further, replacing a hammer head involves forcibly removing the head from the hammer end of the handle, typically by digging out a metal wedge that is driven into the handle end. Replacing the hammer head more than once or twice can require replacing the handle as well, as the region into which the wedge is driven will soon weaken.

But even if replacing a dedicated magnetic hammer head were inexpensive and easy, and such is not the case, the user may not always want the hammer head to be magnetic. For example in many applications there will be no need for a magnetic hammer head. Yet if the user were to inadvertently drop the hammer head into a box of nails, the result would be that many nails would be magnetically attached to the hammer head. The user would then have to waste time removing all but perhaps one of the nails. Further a magnetic hammer head could be a disadvantage when working in an area that might be sensitive to magnetism. For example if the magnetic hammer were used in a computer room where storage diskettes were near the work surface, there is a possibility that data stored on the diskettes might become corrupted. Obviously such potential risk would not exist if the hammer head were not magnetic.

Thus, there is a need for a mechanism that can render the head of a hammer magnetic when desired, but non-magnetic otherwise. Preferably such mechanism should be retrofittably useable with existing hammer heads without requiring modification to the original hammer head. Finally, there is a need for such mechanism that can be inexpensively and readily fabricated, and that can be used even by laypersons.

The present invention provides such a mechanism.

SUMMARY OF THE INVENTION

The invention is a mechanism that comprises a tube-like housing sized to fit, preferably retrofittably, over at least the striking surface portion of a hammer head, and a magnetic unit within the housing. One end of the magnetic unit magnetically secures the mechanism to the striking surface of a hammer, while the other end of the magnetic unit can magnetically retain the head of a nail or other fastener that is to be hammered into a working surface.

The tube-like housing preferably is a non-magnetic material such as copper, aluminum, durable plastic. A sleeve-like region of the housing will fit over at least part of the hammer head striking surface, and is retained in position by the magnetic unit disposed within the housing. The magnetic unit may comprise a single magnet having a first end that can serve as a magnetic striking surface, and having a second end that magnetically contacts the striking surface of the hammer head. Preferably the first and second ends of the magnetic unit will present planar outer surfaces. If desired the magnetic unit may comprise a plurality of magnets, for example a readily replaceable disk magnet at the second end of the unit, and one or more magnets at the first end of the unit, all of the magnets being magnetically in contact with each other.

A conventional (non-magnetic) hammer is rendered magnetic simply by attaching the tube-like housing over at least the striking surface portion of the hammer head. The housing helps frictionally attach and align the mechanism to the hammer head, but primarily it is magnetism from the second end of the magnetic unit that secures the mechanism in place. The mechanism will remain in place until pulled off the hammer head by the user.

Understandably with the mechanism in place, the otherwise conventional hammer is now rendered magnetic, and will so remain until the mechanism is removed from the hammer head by the user. Head of metal nails, screws, staples and other fasteners may be magnetically attached to the first end of the magnetic unit will be retained magnetically until forcibly started into the work surface by a blow from the hammer. In this fashion, a person using the hammer may thus begin to hammer a fastener into a work surface without having to hold the fastener with one hand.

When it is not required that the hammer be magnetic, the user simply pulls the mechanism away off the hammer head, and the hammer is once more a conventional, non-magnetic, hammer. But when a magnetic head is required, the mechanism is simply reattached, and so on.

Other features and advantages of the invention will appear from the following description in which the preferred embodiments have been set forth in detail, in conjunction with the accompanying drawings.

DETAILED DESCRIPTION OF THE PREFERRED EMBODIMENT

Figure 1:
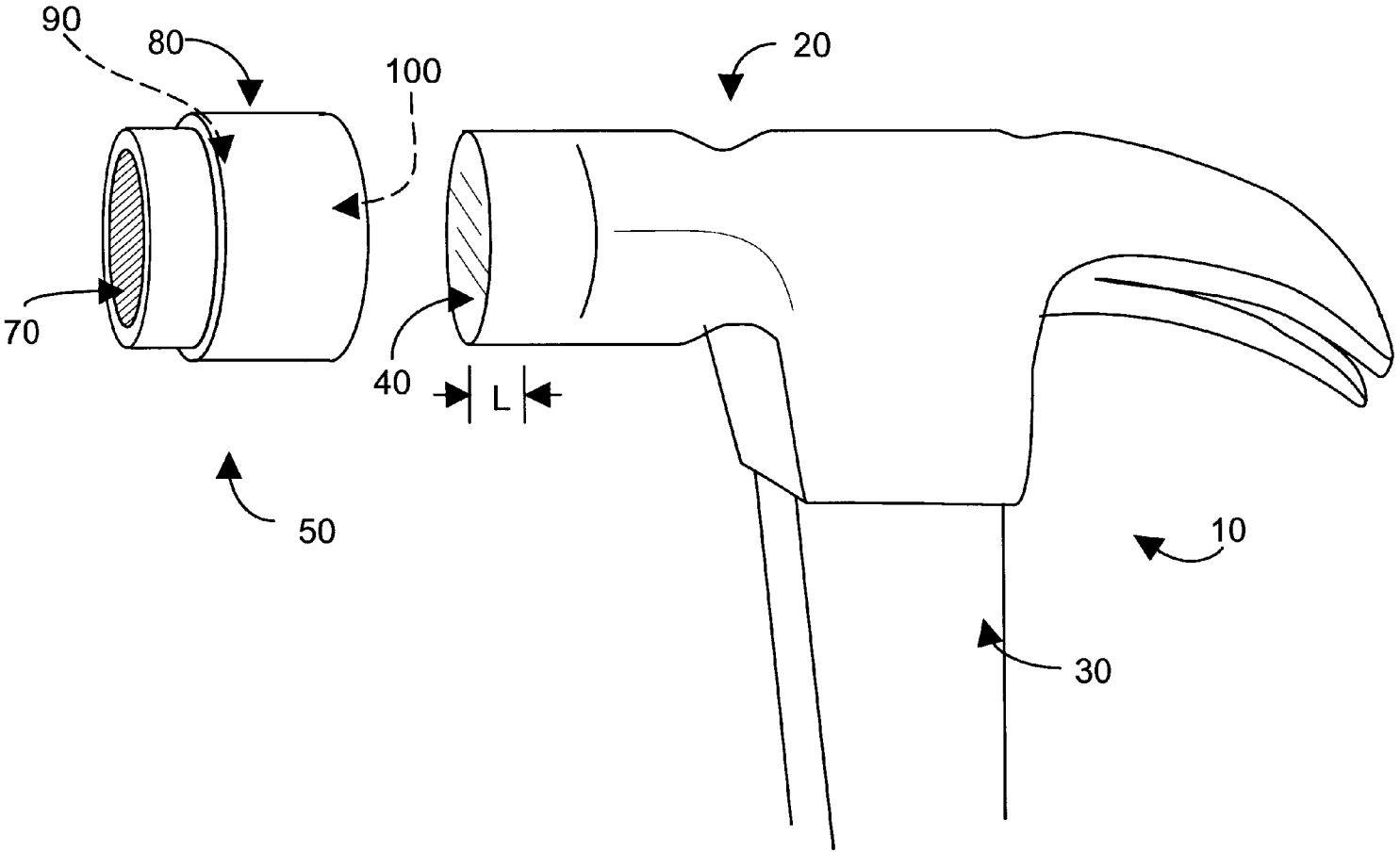
FIG. 1 is a perspective view showing the present invention spaced-part form a conventional hammer head to which the invention will be attached.

FIG. 1 shows a prior art hammer 10 that comprises a metal hammer head 20 attached to the striking end of a handle 30. As shown, a portion of hammer head 20 is typically formed with a planar striking surface 40. In normal use, a user would hold hammer 10 by handle 30 and strike a nail or other fastener with striking surface 40.

FIG. 1 depicts the present invention 50, spaced-apart from hammer 10. As will be described with respect to FIG. 2, the head of a nail or other fastener 60 is magnetically attached to striking surface 70 of the invention. Invention 50 includes a tube-like housing 80, within which is disposed a magnetic unit 90 that comprises at least one magnet. Striking surface 70 represents one end of magnetic unit 90, and a planar region 100, within housing 80, represents a second end of unit 90. The present invention 50 is attached to at least striking surface 40 of the hammer head primarily by magnetic attraction between planar region 100 of unit 90 and the metal striking surface 40. The portion of tube-like housing 80 adjacent hammer 10 is sized to fit collar-like around at least a portion of the head, such that striking surface 20 fits within housing 80 and magnetically engages with region 100 of magnetic unit 80.

Figure 2:
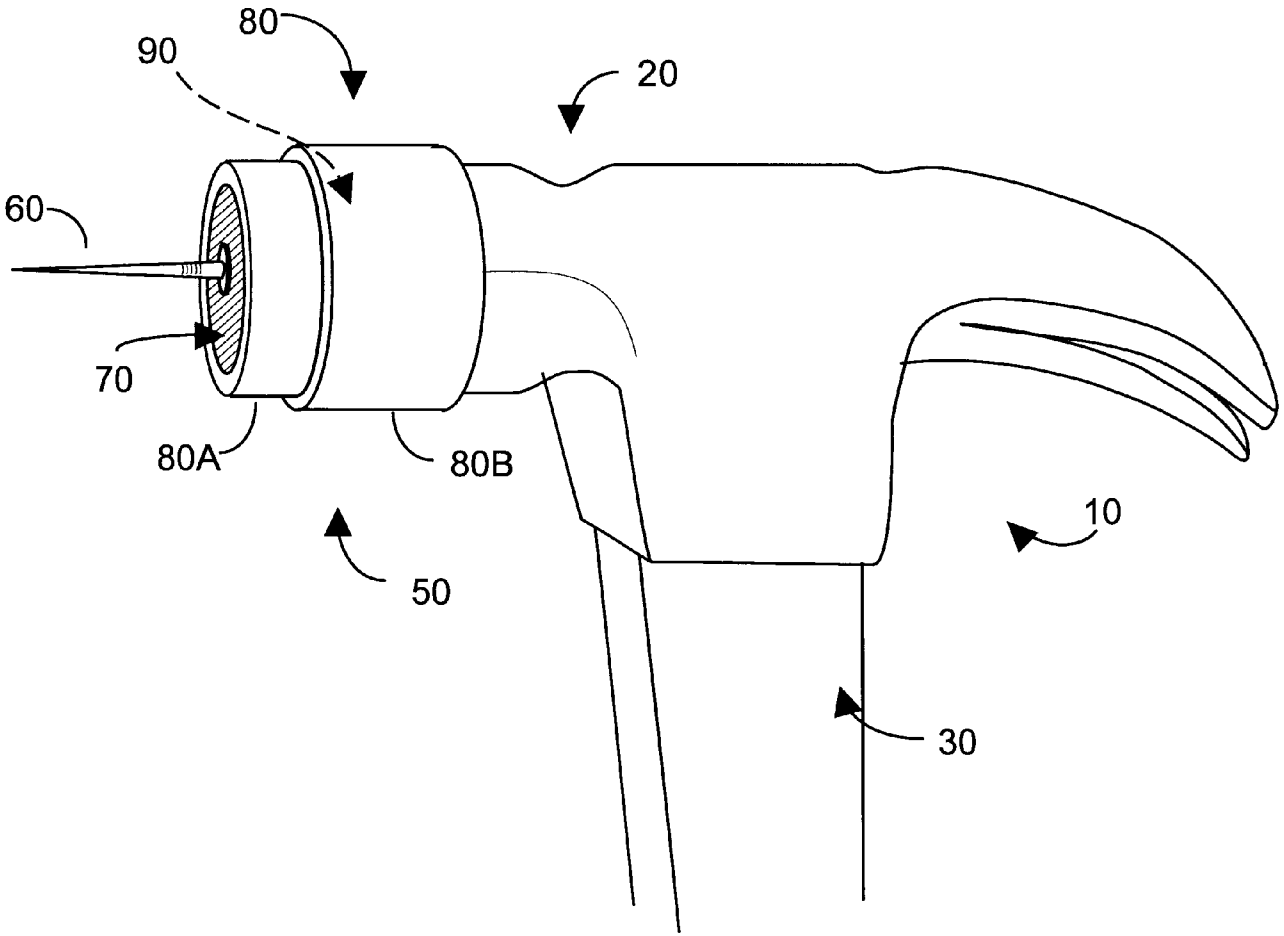
FIG. 2 is a perspective view showing the present invention attached to a conventional hammer head and with a fastener magnetically attached to the present invention.

Turning now to FIG. 2, mechanism 50 has been moved rightward by a user (not shown) such that the collar portion of housing 80 fits over the striking end of the hammer head to encompass at least a side distance L of perhaps 0.25" (60 mm) or more. Hammer-facing end of housing 80 presents a cup-like configuration enabling mechanism 50 to fit over at least the striking portion 40 of the hammer head, with magnetism from unit 80 magnetically retaining the present invention to the metal hammer head.

Housing 80 is made of a durable but preferably non-magnetic material, e.g., copper or aluminum, although other materials including magnetic materials could be used. Housing 80 may have a uniform cross-section, although the embodiment shown in the figures has a reduced striking region cross-section, as a result of the process by which a prototype unit was made. A user can simply hold the handle 30 of hammer 10 with one hand, attach the head of a metallic nail, screw, staple, or other fastener 60 to the magnetic striking surface 70 of unit 80, and proceed to nail the fastener into a work surface using but one hand. Should the user then wish to dip the hammer end into a container of fasteners, the fasteners would only attach to the magnetic surface 70, rather than also to collar-like shell of housing 50 or to the metal hammer head 20. All but one of the fasteners would then be removed, or one fastener only would be attached by the user to surface 70, and hammering would continue.

Figure 3A:
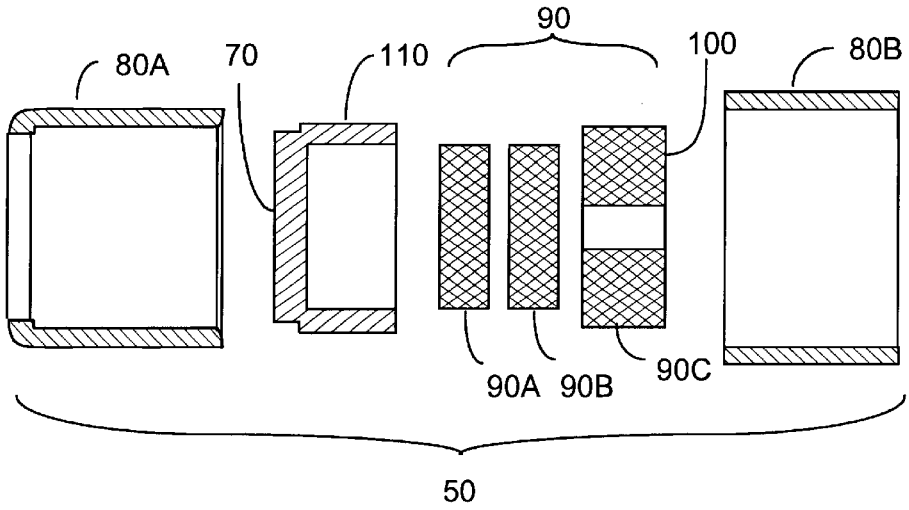
FIG. 3A is a spaced-apart cross-sectional view of a first embodiment of the present invention.

FIG. 3A is a breakaway cross-section of a first embodiment of the present invention. In FIG. 3A, mechanism 50 includes a multi-element magnetic unit 90, and includes a separate striking surface element 110. A bifurcated housing is shown, comprising housing portions 80A and 80B. In the embodiment depicted, housing portions 80A and 80B were fabricated from commonly available copper tubing, sized such that the outer diameter of portion 80A fitted tightly within the inner diameter of portion 80B.

Figure 3B:
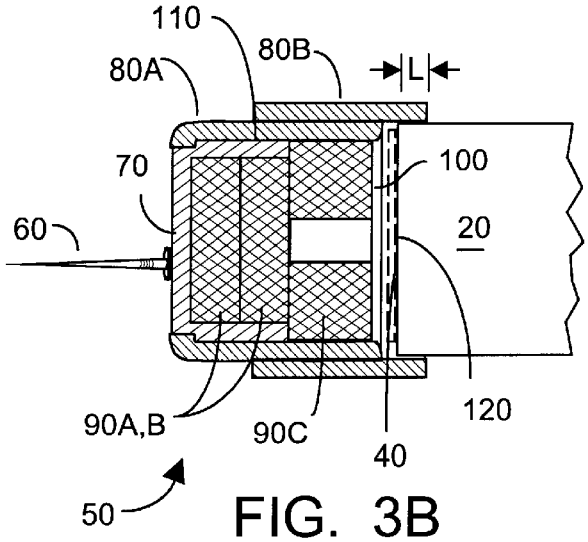
FIG. 3B is a cross-sectional view of the embodiment of FIG. 3A.

In this embodiment, magnetic unit 90 comprises a pair of disk-shaped magnets 90A and 90B, and a button-type magnet 90C. A steel or other magnet metal striking surface 70 is also provided. FIG. 3B depicts mechanism 50 in its normal configuration, e.g., not broken-apart, and also depicts the striking surface portion of a metal hammer head 20. In this embodiment magnetic surface 70 (to which the head of a metal fastener is magnetically attachable) is outer surface portion of element 110. As shown, magnets 90A and 90B fit within the cylindrical-shaped interior of element 110, and are magnetically retained therein. Element 110 with magnets 90A and 90B (or a single magnet, if desired) within is fitted within the front portion of housing portion 80A. As shown in FIGS. 3A and 3B, the front region of portion 80A is flared inward slightly to define an open circular region (thus exposing surface 70 of element 110), which flare prevents element 110 from sliding to the left (in the figures shown). Magnet 90C attaches magnetically to magnet 90B, and provides magnetic surface 100, which magnetically secures mechanism 50 to the metal striking surface 40 of the head 20 of hammer 10. Note too that there is an overlap of distance at least L between the inner rim of housing 80B and the perimeter of a portion of the hammer head.

It will be appreciated that causing hammer 10 to be magnetic requires but a few seconds for a user to slip mechanism 50 onto at least the striking surface region of the hammer head. The head of a fastener 60 is then attached, using magnetism present to surface 70, whereupon a user can swing the hammer with one hand to start and drive home the fastener. When hammer 10 is not required to be magnetic, the user simply slides mechanism 50 off of the hammer head.

An advantage of the configuration shown in FIGS. 3A and 3B is that unit 110 absorbs the physical impact of striking fasteners with the hammer head, thus sparing magnetic unit 90 from damage. But should magnet 90A eventually become damaged due to repeated impacts, or if unit 110 is omitted such that surface 70 is actually the outer surface of a magnet, it is a simple task to replace the outmost magnet, here magnet 90A. Note too that if desired, a thin wafer 120 of non-magnet material might be attached to surface 100 of magnet 90C to intentionally reduce somewhat the magnetic force retaining mechanism 50 to surface 40 of the hammer head. Alternatively, wafer 120 could be magnetic material, but with holes formed in the material to reduce the effective magnetic attraction surface area, to thus reduce the magnetic retaining force. Such reduction in magnetic force would reduce any tendency of the hammer head to accumulate residual magnetism. Naturally, the resultant magnetism would still be sufficiently strong to ensure that mechanism 50 does not fly off the hammer head in the course of use.

Figure 3C:
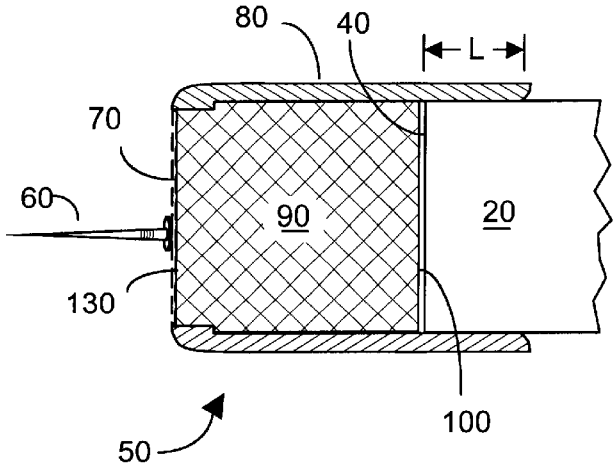
FIG. 3C is a cross-sectional view of an alternative embodiment of the present invention using a single element magnetic unit.

FIG. 3C depicts an embodiment in which magnetic unit 90 is a single magnet, and in which housing 80 is simply a cylindrical shell, preferably with a flared-in edge to help retain magnetic unit 90 in place. In this embodiment, one surface of the magnet is striking surface 70, and the other surface of the magnet is magnetic surface 100, which helps retain mechanism 50 to surface 40 of the hammer head. It is understood that a metal disk 130 could be provided within housing 80 to act as striking surface 70, and thus reducing the likelihood of damaging the adjacent surface of magnet 90. As such, material 130 is preferably durable and responsive to magnetism, e.g., a ferrous metal. Similarly, if desired, a wafer of non-magnetic material 120 could be attached to the other end of magnet 90 to intentionally reduce the magnet attraction to the hammer head.

It will be appreciated that manufacturing cost of the present invention in its various embodiments is relatively low. If the magnetic unit eventually loses magnetism or should become otherwise damaged, the magnetic unit or the damaged sub-component may be replaced, or indeed the entire mechanism may be replaced.

Modifications and variations may be made to the disclosed embodiments without departing from the subject and spirit of the invention as defined by the following claims. For example, but for considerations of mechanism stability, housing 80 could be disposed of, especially if the hammer-facing surface of the magnetic unit had a cup-like or tube-like shape to fit at least partially over the striking surface region of the hammer head.

What is claimed is:

1. A retrofittable attachment for use with a hammer having a head whose striking surface region is non-magnetic and requires no modification to accept said attachment, said attachment rendering said head of said hammer magnetic for purposes of starting a metallic fastener, the attachment comprising:

a magnetic unit having a first surface that magnetically attaches to at least a portion of the unmodified said striking surface region of said head of said hammer, and having a second surface to which a head section of said fastener is magnetically attachable; and a housing defining an interior region sized to receive said magnetic unit, and having a hammer head facing region sized to fit about at least a portion of said striking surface region of said hammer head;

wherein said attachment is retrofittably attachable to render said hammer magnetic without requiring modification of said head, and is removable therefrom to render said hammer non-magnetic.

2. The attachment of claim 1, wherein said housing is fabricated from non-metal material.

3. The attachment of claim 1, wherein said housing is fabricated from a nonmagnetic metal.

4. The attachment of claim 1, wherein said magnetic unit is a single magnet.

5. The attachment of claim 1, wherein said magnetic unit comprises at least two magnets.

6. The attachment of claim 1, further including means for mechanically protecting said second surface of said magnetic unit.

7. The attachment of claim 1, further including a ferrous metal disk, attached to said second surface of said magnetic unit.

8. The attachment of claim 1, further including means for reducing magnetic attraction between said first surface of said magnetic unit and said striking surface region of said head of said hammer.

9. A retrofittable attachment for use with a hammer having a head whose striking surface region is non-magnetic and requires no modification to accept said attachment, the attachment rendering said head of said hammer magnetic for purposes of starting a metallic fastener, the attachment comprising:

a cup-shaped housing sized to fit at least partially over the unmodified said striking surface region of said head of said hammer;

a magnetic unit sized to fit within said housing, said magnetic unit including at least one magnet and having a first surface and a second surface;

wherein a head of said fastener is magnetically attachable to said first surface of said magnetic unit, and said second surface of said magnetic unit is magnetically attachable to said striking surface of said head of said hammer;

wherein said attachment is retrofittably attachable to render said hammer magnetic without requiring modification of said striking surface region, and is removable therefrom to render said hammer non-magnetic.

10. The attachment of claim 9, wherein said housing comprises tubing.

11. The attachment of claim 9, wherein said housing is fabricated from a tubing material selected from a group consisting of (a) copper, (b) aluminum, and (c) plastic.

12. The attachment of claim 9, wherein said magnetic unit includes one magnet.

13. The attachment of claim 9, wherein said magnetic unit includes at least two magnets.

14. The attachment of claim 9, further means for mechanically protecting said first surface of said magnetic unit.

15. The attachment of claim 9, further including a ferrous metal disk, attached to said first surface of said magnetic unit.

16. The attachment of claim 9, further including means for reducing magnetic attraction between said second surface of said magnetic unit and said striking surface region of said head of said hammer.

17. A method of retrofittably rendering magnetic the non-magnetic metal head of a hammer without requiring modification of a striking surface region of said head, the method comprising the following steps:

(a) removably attaching a cup-shaped housing to at least fit over the unmodified said striking surface region of said head of said hammer; and (b) disposing within said cup-shaped housing a magnetic unit including at least one magnet, said magnetic unit having a first surface and a second surface such that said first surface of said magnetic unit magnetically attaches to said striking surface region of said head of said hammer;

wherein a head of a metallic fastener is magnetically attachable to said second surface of said magnetic unit;

wherein retrofittably attaching said housing and magnetic unit renders said hammer magnetic, and removing said housing and magnetic unit renders said hammer non-magnetic.

18. The method of claim 17, wherein step (b) includes disposing a single magnet within said cup-shaped housing.

19. The method of claim 17, wherein step (b) includes attaching a magnetically conductive protective element to said second surface.

20. The method of claim 17, wherein step (b) includes attaching an element to said first surface to control magnetic attraction between said first surface and said striking surface of said head of said hammer.

* * * * *